United States Patent [19]

Svensson

[11] 4,116,485

[45] Sep. 26, 1978

[54] LOADING CAGE FOR BULK GOODS

[75] Inventor: Assar Svensson, Ersmark, Sweden

[73] Assignee: Skega AB, Ersmark, Sweden

[21] Appl. No.: 715,467

[22] Filed: Aug. 18, 1976

[51] Int. Cl.[2] ..... B62P 1/00

[52] U.S. Cl. ..... 296/39 R; 296/28 R

[58] Field of Search ..... 296/39 R, 28 R

[56] References Cited

U.S. PATENT DOCUMENTS

| | | | |
|---|---|---|---|
| 1,259,138 | 3/1918 | Sachs | 296/39 R |
| 2,912,137 | 11/1959 | Taylor | 296/39 R |
| 3,418,005 | 12/1968 | Allina | 296/39 R |

*Primary Examiner*—Philip Goodman

*Attorney, Agent, or Firm*—Townsend and Townsend

[57] ABSTRACT

A bulk material carrying container defined by a framework including a base and a pair of opposing, generally parallel upright sides carried by the base. An elastomeric sheet is secured to and suspended between the sides so that it forms a generally concave receptacle into which bulk material and the like may be dropped. The sheet is dimensioned so that it is substantially freely suspended between the sides. A multiplicity of sheet supporting, flexible ropes are anchored to the sides and engage an underside of the sheet so as to support the sheet and materials carried therein.

14 Claims, 5 Drawing Figures

LOADING CAGE FOR BULK GOODS

Figure 1:
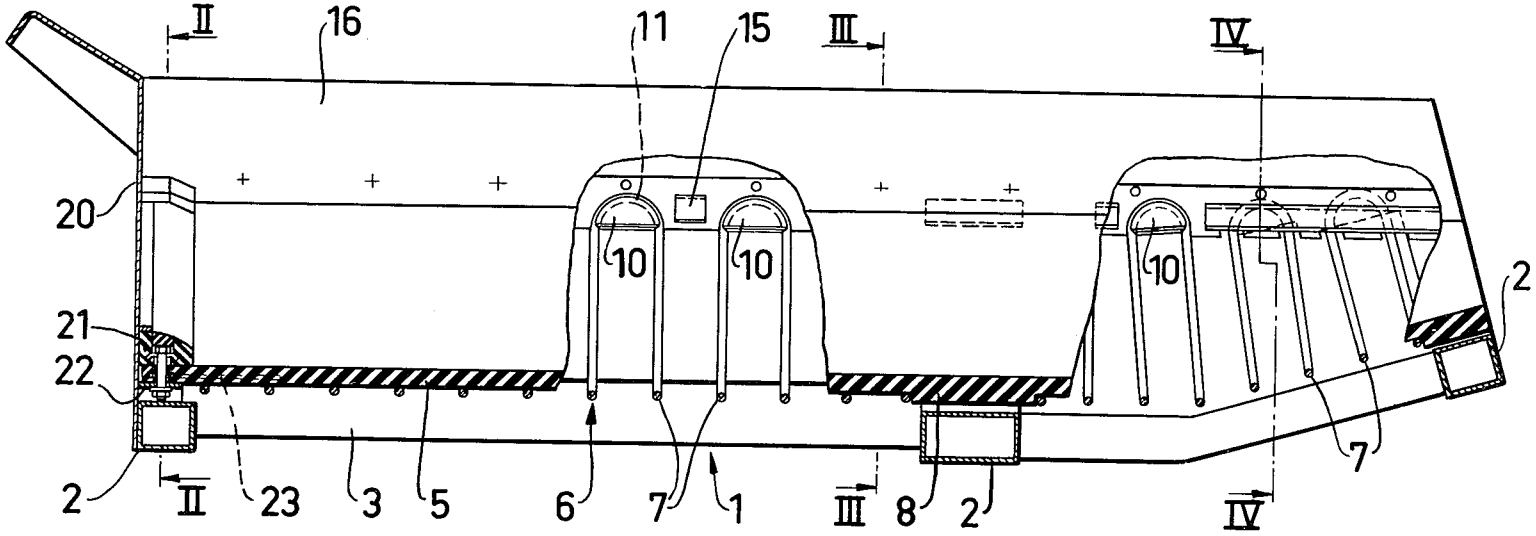

This invention relates to a loading cage for bulk goods, for example ore, broken rock and the like, intended especially but not exclusively for haulage cars and of the type comprising a structure designed as a frame, a skeleton or the like and within said structure a layer of an elastomer material forming at least the bottom of the loading cage.

It is a known measure to line such loading cages and other goods and transport containers for bulk goods with an elastomer material in order to reduce the wear of the cage walls and bottom which primarily is caused by the bulk goods pieces dropping down at the filling of the cage, which pieces at the moment of their impact can have in certain cases an energy content of up to 25 tonmeters. This elastomer or wear-resistant rubber layer serving as wear lining was from the beginning and in certain constructions still is applied rigidly to the rigid walls and bottom of the cage. Consequently, the inherent elastic properties of the elastomer material cannot fully be utilized for damping or absorbing the energy of the bulk goods pieces dropping down and, instead, the thickness of the elastomer layer must be increased in order to avoid percussions and rapid wear. These known linings, therefore, are expensive and very heavy, thereby limiting their practical use, especially in the case of road haulages where greatest possible carrying capacity is desired.

In order to eliminate these disadvantages, it was proposed to divide the elastomer layer serving as a wear lining into a plurality of plate-like pieces, each forming a wall and bottom portion, respectively, in the cage and each individually be attached detachably in several points along its edges to beams comprised in the structure, between which beams the plates are clamped spaced from the structure proper, so that they can springily yield to some extent for the bulk goods pieces dropping down, in the same manner substantially as a so-called trampoline. In order to enable the elastomer material used for this purpose to take up the tensile stresses to which it undoubtedly will be exposed, and in order not to have to make the distance between the lower surface of the layer and the structure too great, because a great distance would under given conditions reduce the carrying capacity, the plate-shaped pieces must be reinforced. It is, therefore, previously known to design the reinforcement elastic and arrange it uniformly divided in the pieces. It was found, however, that this known reinforcement does not withstand heavy concentrated loads caused, for example, by large, sharp-pointed bulk goods pieces at the moment of impact, but that local damages are caused in the reinforcement, with the result that the entire pieces must be exchanged. For this reason, this type of lining of loading cages has not been applied in practice, at least not for large pieces of bulk goods.

The object of the present invention, therefore, is to provide a loading cage for bulk goods, with a lining of an elastomer material and applicable in practice for all kind of bulk goods and the like. This object is achieved thereby that the loading cage according to the invention shows the characterizing features defined in the attached claims.

Figure 5:
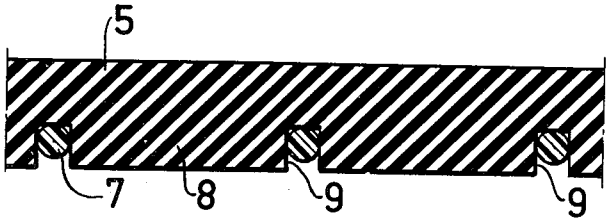
Figure 2:
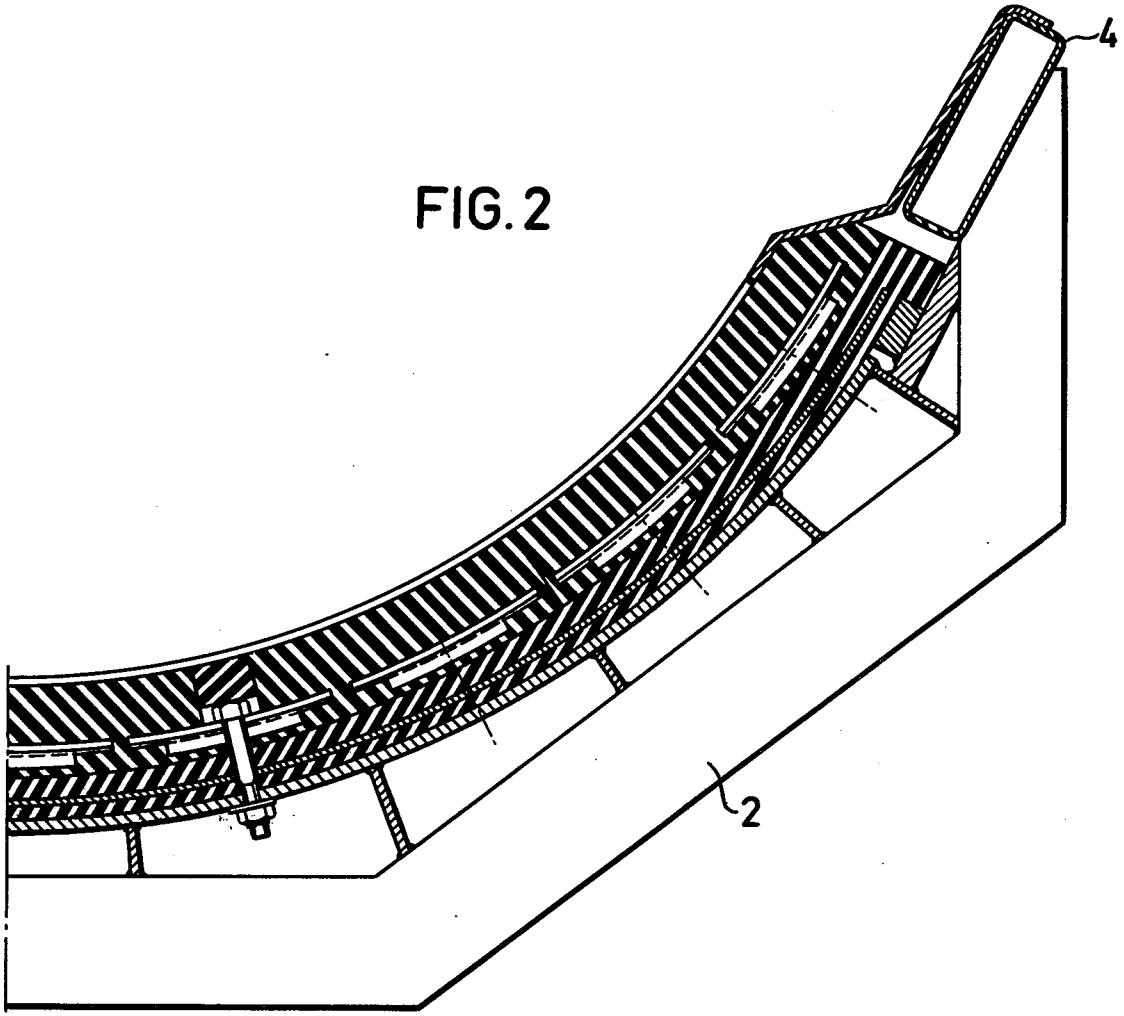
Figure 3:
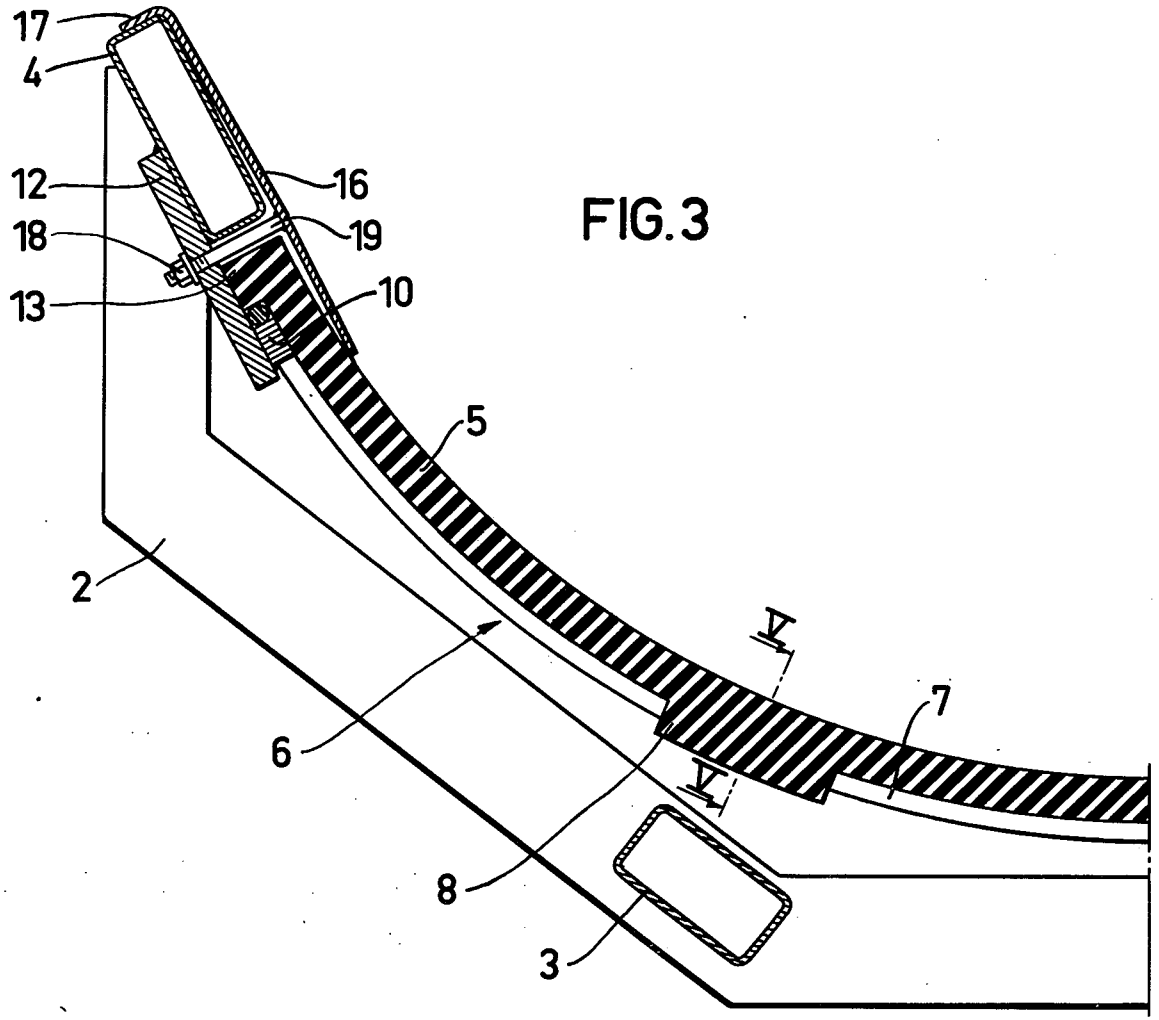
Figure 4:
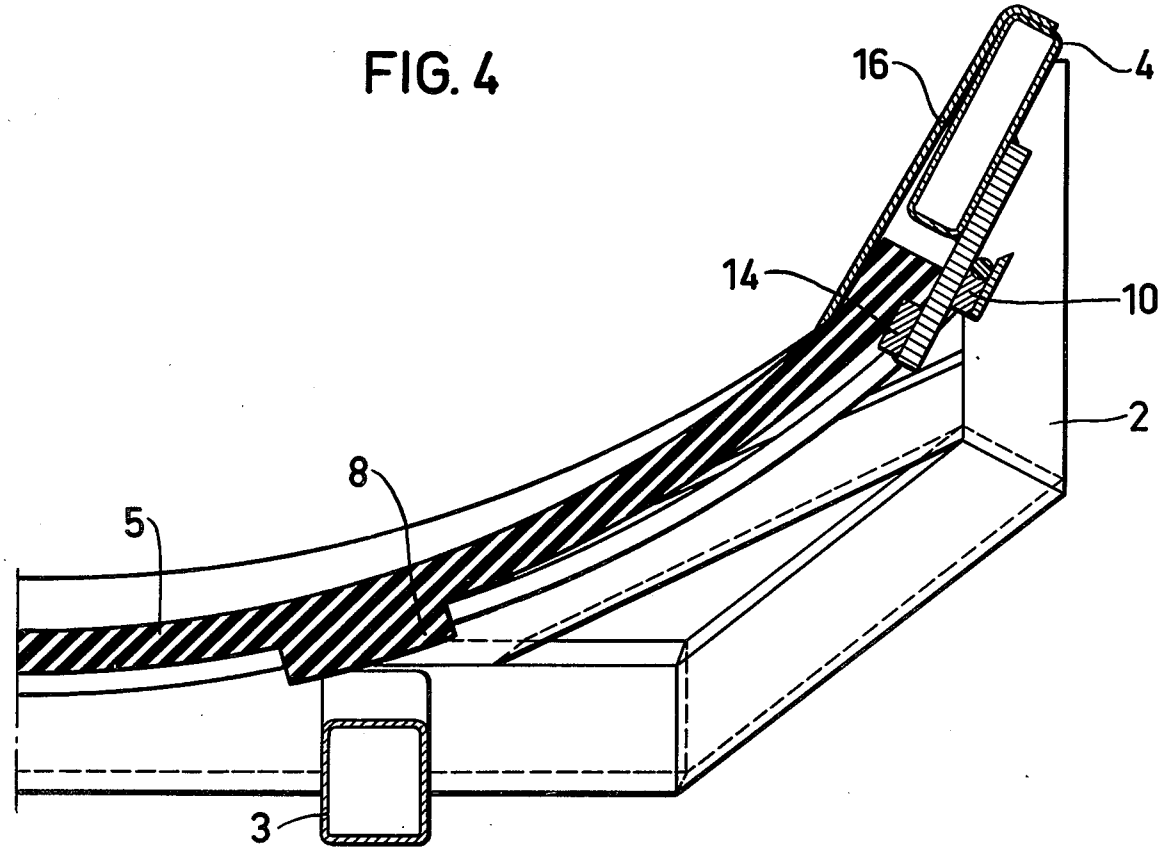

The invention is described in greater detail in the following, with reference to the accompanying drawings, in which FIG. 1 is a longitudinal section through an embodiment chosen as an example of the loading cage according to the invention, certain parts thereof being cut away for reason of clearness, FIG. 2 is a partial section along the line II—II in FIG. 1, FIG. 3 is a partial section along the line III—III of FIG. 1, FIG. 4 is a partial section along the line IV—IV in FIG. 1, and FIG. 5 is a section along the line V—V in FIG. 3.

The embodiment according to the invention shown in the drawings refers to a loading cage for a so-called dumper and comprises a basic structure or frame 1 consisting of longitudinal structural members 3 and 4 which may have, as shown, the form of box girders. The structure of the loading cage, thus, has the character of an open frame-work and, therefore, can be built as a relatively light-weight structure, which contributes to an increased carrying capacity of the loading cage.

The structure 1 of more or less shell-type is covered on its inside by a layer 5 of an elastomer material, for example wear-resistant rubber, forming the side walls and bottom of the loading cage. The elastomer layer 5 is suspended like a hammock within the structure and supported according to the invention by a carrying layer 6, which also is suspended freely in the structure.

This carrying layer 6 suspended spaced above the structure consists of one or more ropes or similar load-carrying members of polyester, rayon, nylon or like material, which has a higher tensile strength but a lower elastic ductility than the material in the layer 5 and may be assembled of layers with or without twisting, and are distributed in the longitudinal direction of the loading cage on a plurality of transverse strands 7, i.e. strands extending in transverse direction of the loading cage. The thickness of the strands, or more correctly of the rope or ropes, and the relative space between them, and therewith the number of strands per running meter, can vary from one case to another, depending on the application field and the kind of goods to be loaded and transported, and determined in view of the desired bearing capacity of the sparse carrying layer 6, which to some extent depends on the thickness of the elastomer layer 5. Owing to the sparse carrying layer 6 consisting of ropes, however, the thickness of the elastomer layer can be substantially reduced compared with corresponding layers at the known structures, at the same time as the distance between the elastomer layer 5 and the structure can be held on a relatively low level. These factors also contribute efficiently to providing the loading cage according to the invention with a high carrying capacity. In order to prevent damaging percussions, furthermore, according to the invention the elastomer layer 5 can be provided on its lower surface with thickened portions 8 directly in front of the structural members of the frame. These portions may have the form of coherent ridges or of separate cushions with recesses 9 where necessary for the strands 7. See FIG. 5. Through these recesses the strands 7 also are fixed in their position and thus prevented from moving too much relative to each other.

At the shown embodiment of the invention the ropes have the form of endless loops, each forming two strands 7 and suspended about holders 10 on each side of the structure with well rounded arc-shaped grooves 11 for the loops, so that the loops will not be broken or damaged in another way when they slide relative to their holders. The holders 10 on the forward horizontal part of the structure 1 are fastened on the inside of a bar 12 connected to the longitudinal upper girders 4 and simultaneously form support shoulders for the elastomer layer 5, which at its longitudinal edges is formed with a suspension strip 13 engaging behind said forward holders 10. The holders 10 on the rearward part of the structure 1, however, which is inclined upward and at the embodiment shown slightly tapering, are arranged on the outside of said bars 12, for the only reason of rendering it possible to provide the rope loops at the embodiment shown with equal length. This has a certain importance with respect to stock-keeping and facilitates the exchange of the loops in the case of possible damages. At other embodiments, thus, all holders can be arranged on the inside of the bars 12 or directly on the girders 4 or in another place deemed suitable. In such a case, the support strips 14 especially arranged at the embodiment shown on the inside of the bars 12 for suspending the elastomer layer on said rearward part of the structure are not required. At the embodiment shown, further, separate support shoulders 15 are provided between the forward holders 10 for the elastomer layer 5, but these support shoulders can be omitted, if so desired.

The elastomer layer 5 is clamped against the bars 12 by means of clamping strips 16, which may be formed with a flange 17 embracing the girder 4 and is clamped at the bars 12 by means of nuts 18 and pin bolts 19 or like fasteners secured on the clamping strip. This clamping of the elastomer layer 5 is per se sufficient, but in order to prevent leakage between the front wall 20 of the loading cage and the forward edge of the elastomer layer, at the embodiment shown said layer 5 is secured on the structure by means of a reinforced holding strip 21 of, for example, elastomer material provided on said layer. The holding strip 21, more precisely, is screwn by means of pin bolts and nuts on a flange 22 secured in the front wall of the loading cage, with the elastomer layer 5 lying therebetween. The layer 5 in this its portion is reinforced by a flat iron and, in order to withstand certain tensile stresses, reinforced along a relatively short distance, as indicated at 23 in FIG. 1.

The invention is not restricted to the embodiment described above and shown in the drawings, but can be modified in many different ways within the scope of the idea of the invention.

What I claim is:

1. A container for receiving and carrying heavy bulk goods dropped into the container without suffering damage, the container comprising in combination: a substantially rigid supporting framework including means defining a base for the container and first and second opposite, generally parallel side members extending upwardly from the base; a sheet of an elastomeric material extending over the length of the container and having longitudinal edges disposed adjacent the side members, the sheet between its longitudinal edges defining at least a floor of a receptacle for the bulk goods and being further dimensioned so that such portions are at all times spaced apart from the framework; a plurality of generally parallel, flexible carrying means extending between the sides of the framework and in contact with an underside of the sheet so as to support the sheet over its length transversely to the carrying means; and means anchoring the carrying means to the sides; whereby bulk goods dropped into the receptacle are received by the elastomeric sheet without contacting and thereby damaging the rigid framework while the framework, in conjunction with the sheet and the carrying means supports the weight of the bulk goods.

2. Apparatus according to claim 1 wherein the carrying means comprises a cable means supporting the underside of the sheet at spaced, longitudinally arranged intervals.

3. A container according to claim 2 wherein at least pairs of cable means are defined by endless cable means loops, and wherein the anchoring means comprises holders attached to the opposite sides of the framework.

4. A container according to claim 3 wherein the endless cable loops each define two generally parallel cable strands, and wherein the holders comprise members secured to the sides of the framework, projecting towards each other and each having upwardly open, generally semi-circular grooves, and wherein portions of the loops are disposed within said grooves.

5. A container according to claim 2 wherein the cable means comprises a plurality of generally parallel ropes constructed of a material having a higher tensile strength and a lower elastic ductility than the elastomeric material of the sheet.

6. A container according to claim 5 wherein the higher tensile strength material comprises a polyester material.

7. A container according to claim 5 wherein the higher tensile strength material comprises rayon.

8. A container according to claim 2 wherein the framework includes girders defining portions of the framework, and wherein at least one section of the sheet in the vicinity of such girders has an enlarged thickness so as to define a cushion as a protection for the frame against high impact percussions from bulk goods dropped into the container.

9. A container according to claim 8 including a plurality of recesses formed in the enlarged thickness sections of the sheet and positioned and dimensioned so as to receive the cable means therein.

10. A container according to claim 3 wherein the sheet includes suspension strips along its longitudinal edges, the suspension strips being defined by portions of the sheet having an increased thickness and engaging oppositely arranged protrusions carried by the sides of the framework.

11. A container according to claim 10 wherein the protrusions are defined by the holders for the cable loops.

12. A container according to claim 10 including clamping plates arranged along at least a portion of the longitudinal edges of the elastomeric sheet, and means biasing the clamping means against the sheet in the vicinity of the longitudinal edges thereof so as to bias and clamp the elastomeric sheet against the protrusions.

13. A container for receiving and carrying heavy bulk goods dropped into it, the container comprising: a substantially rigid supporting framework including means defining a base for the container, first and second, opposite, generally parallel, longitudinally extending beams disposed above the base, and a plurality of oppositely positioned cable holders mounted to and arranged at spaced intervals over the lengths of the beams, the holders including upwardly open recessed grooves; a plurality of endless cable loops placed into the grooves of opposing cable holders, the cables having a length so that cable strands between the holders are freely suspended and do not contact any portion of the framework; a sheet of an elastomeric material extending over a substantial portion of the length of the beams, having longitudinal edges proximate the beams and an underside facing towards the base which is engaged and carried by the cable strands so as to define a generally concave receptacle for the bulk goods which is spaced apart from the framework; whereby hard, heavyweight bulk goods dropped into the receptacle are received therein and resulting impact forces are absorbed by the sheet and by the underlying cable loops without causing damage to the framework.

14. A container according to claim 13 wherein the sheet includes suspension strips along its longitudinal edges, the suspension strips being defined by portions of the sheet having an increased thickness and engaging the oppositely protruding holders for the cable loops, clamping plates arranged along at least a portion of the longitudinal edges of the elastomeric sheet, and means biasing the clamping means against the sheet in the vicinity of the longitudinal edges thereof so as to bias and clamp the sheet against the holders.

* * * * *